US007693473B2

(12) United States Patent
Ardery et al.

(10) Patent No.: US 7,693,473 B2
(45) Date of Patent: Apr. 6, 2010

(54) FUSER ASSEMBLY HAVING COMPLAINT STOPPING FLANGE

(75) Inventors: Jeffrey Allen Ardery, Richmond, KY (US); Douglas Campbell Hamilton, Lexington, KY (US); Katherine Mary Mulloy, Lexington, KY (US); Jason Kyle Romain, Versailles, KY (US)

(73) Assignee: Lexmark International, Inc., Lexington, KY (US)

( * ) Notice: Subject to any disclaimer, the term of this patent is extended or adjusted under 35 U.S.C. 154(b) by 362 days.

(21) Appl. No.: 11/687,826

(22) Filed: Mar. 19, 2007

(65) Prior Publication Data

US 2008/0232870 A1 Sep. 25, 2008

(51) Int. Cl.
*G03G 15/20* (2006.01)

(52) U.S. Cl. ..... 399/329

(58) Field of Classification Search ..... 399/329
See application file for complete search history.

(56) References Cited

U.S. PATENT DOCUMENTS 5,742,878 A * 4/1998 Kuroda ..... 399/122
6,671,488 B2 12/2003 Izawa et al.
2005/0220509 A1 * 10/2005 Kubochi et al. ..... 399/329

* cited by examiner

*Primary Examiner*—David M Gray
*Assistant Examiner*—Andrew V Do

(57) ABSTRACT

A fuser assembly configured to fix a toner image to a sheet of print media includes a fuser belt having a first side edge and a second side edge. A plurality of end cap assemblies is positioned to locate the fuser belt. The plurality of end cap assemblies include a first end cap assembly having a first compliant stopping flange positioned to engage the first side edge of the fuser belt, and a second end cap assembly having a second compliant flange positioned to engage the second side edge of the fuser belt.

19 Claims, 7 Drawing Sheets

FUSER ASSEMBLY HAVING COMPLAINT STOPPING FLANGE

BACKGROUND OF THE INVENTION

1. Field of the Invention

The present invention relates to electrophotographic imaging devices, and, more particularly, to a fuser assembly having a compliant stopping flange.

2. Description of the Related Art

An electrophotographic imaging apparatus, such as a laser printer, forms a latent image on a surface of a photoconductive material be selectively exposing an area of the surface to light. The latent electrostatic image is developed into a visible image by electrostatic toners which contain pigment components and thermoplastic components. The photoconductor may be either positively or negatively charged, and the toner system similarly may contain negatively or positively charged particles. A print medium (e.g., a sheet of paper) or intermediate transfer medium is given an electrostatic charge opposite that of the toner and then passed close to a surface of the photoconductor, pulling the toner from the photoconductor onto the paper or immediate medium in the pattern of the image developed from the photoconductor. After the image is transferred to the print medium, the print medium is processed through a fuser assembly where it is heated and pressed. The fuser assembly includes a set of fuser rolls or belts, under heat, which melts and fixes the toner to the print medium surface thereby producing the printed image.

A belt fuser contains a belt whose axial location is controlled by an end cap attached to each end of a heater housing. The belt may be, for example, a polyimide tube having a Teflon® coating. The end cap has an approximate circular surface that fits inside the inside diameter of the belt to locate the belt up and down and front to back in the fuser. The approximate circular surface of the end cap is a shape to match the shape that the belt wants to take when the belt is pressed up against the heater by the back up roll. The end cap has a flange that controls the left to right axial movement of the belt. The belt is rotated by paper moving through the nip produced by the back up roller being pressed against the belt riding over a flat ceramic heater. The back up roll rotates and drives the paper. The end caps do not rotate.

There is clearance between the belt and the portion of the end cap fitting inside the belt's inner diameter so as to minimize friction between these surfaces. This clearance allows the belt axis of rotation to not be parallel to the back up roll axis of rotation. Also, the assembly of the belt and end caps may not be parallel to the back up roll axis of rotation due to manufacturing variations. Both of these effects produce a relative angle between the belt axis of rotation and the back up roll axis of rotation which causes the belt to move so that one end is pushing against the flange on the end cap. The end cap material contains glass fibers because of the load, e.g., 11 to 20 pounds, that the end cap must transmit to the back up roll to form the nip. During operation, the end of the belt wears away the plastic skin that covers these glass fibers. Once the glass fibers are exposed, the glass fibers will wear the side ends(s) of the fuser belt and sometimes the side ends(s) of the belt will catch on these fibers will and tear. This tear causes the belt to fail and often occurs before the fuser has reached its desired life.

The relative angle between the belt axis of rotation and the back up roll axis of rotation also creates a point load. In addition to accelerated wear due to this point load, another failure mode is caused by this point lead, which is a localized buckling of the fuser belt as the fuser belt contacts the end cap.

This buckling usually results in the belt bending over short distances. Since it is localized the buckling fatigues the end of the belt and can put a crease in the belt. Also, in more extreme cases, due to system tolerances, the belt can have noisy dynamic buckling, which can be easily heard outside of the machine. In any case, buckling results in fatigue of the belt which results in cracks in the belt in the axial direction and circumference direction. These cracks cause failure of the belt. Also, another cause for a point load on the belt is the run out of the belt. Using coupled force transducers, a belt force oscillation on the end cap flange has been observed with the same frequency as the belt rotation.

FIG. 1 is a graph having a shaded area DF1 representing a region of no belt deformation of a prior art fuser system that does not incorporate aspects of the present invention. In FIG. 1, the X axis is the relative angle between the belt axis of rotation and the back up roll axis of rotation that is given in terms of a displacement of the AC connector end of the ceramic heater with respect to the back up roll shaft, which is called plug skew in millimeters (mm). The Y axis is the rotation of the end cap flange in degrees. As is observed from the graph of FIG. 1, the graph region below the X axis depicts a region almost completely covered with belt deformation.

What is needed in the art is a fuser assembly that reduces fuser belt deformation.

SUMMARY OF THE INVENTION

The terms "first" and "second" preceding an element name, e.g., first end cap assembly, second end cap assembly, etc., are used for identification purposes to distinguish between similar elements, and are not intended to necessarily imply order, nor are the terms "first" and "second" intended to preclude the inclusion of additional similar elements.

The invention, in one form thereof, is directed to a fuser assembly configured to fix a toner image to a sheet of print media. The fuser assembly includes a fuser belt having a first side edge and a second side edge. A plurality of end cap assemblies is positioned to locate the fuser belt. The plurality of end cap assemblies include a first end cap assembly having a first compliant stopping flange positioned to engage the first side edge of the fuser belt, and a second end cap assembly having a second compliant flange positioned to engage the second side edge of the fuser belt.

The invention, in another form thereof, is directed to an electrophotographic imaging apparatus for forming an image on a sheet of print media. The electrophotographic imaging apparatus includes a media feed section for feeding the sheet of print media along a media feed path. A laser scanning device is configured to produce a scanned light beam. An image-forming device has a photosensitive body, and is configured to use the scanned light beam to form a latent image on the photosensitive body and develop the latent image to form a toner image that is transferred to the sheet of print media. A fuser assembly is configured to fix the toner image to the sheet of print media. The fuser assembly includes a fuser belt having a first side edge and a second side edge. A plurality of end cap assemblies is positioned to locate the fuser belt. The plurality of end cap assemblies include a first end cap assembly having a first compliant stopping flange positioned to engage the first side edge of the fuser belt, and a second end cap assembly having a second compliant flange positioned to engage the second side edge of the fuser belt.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 2:
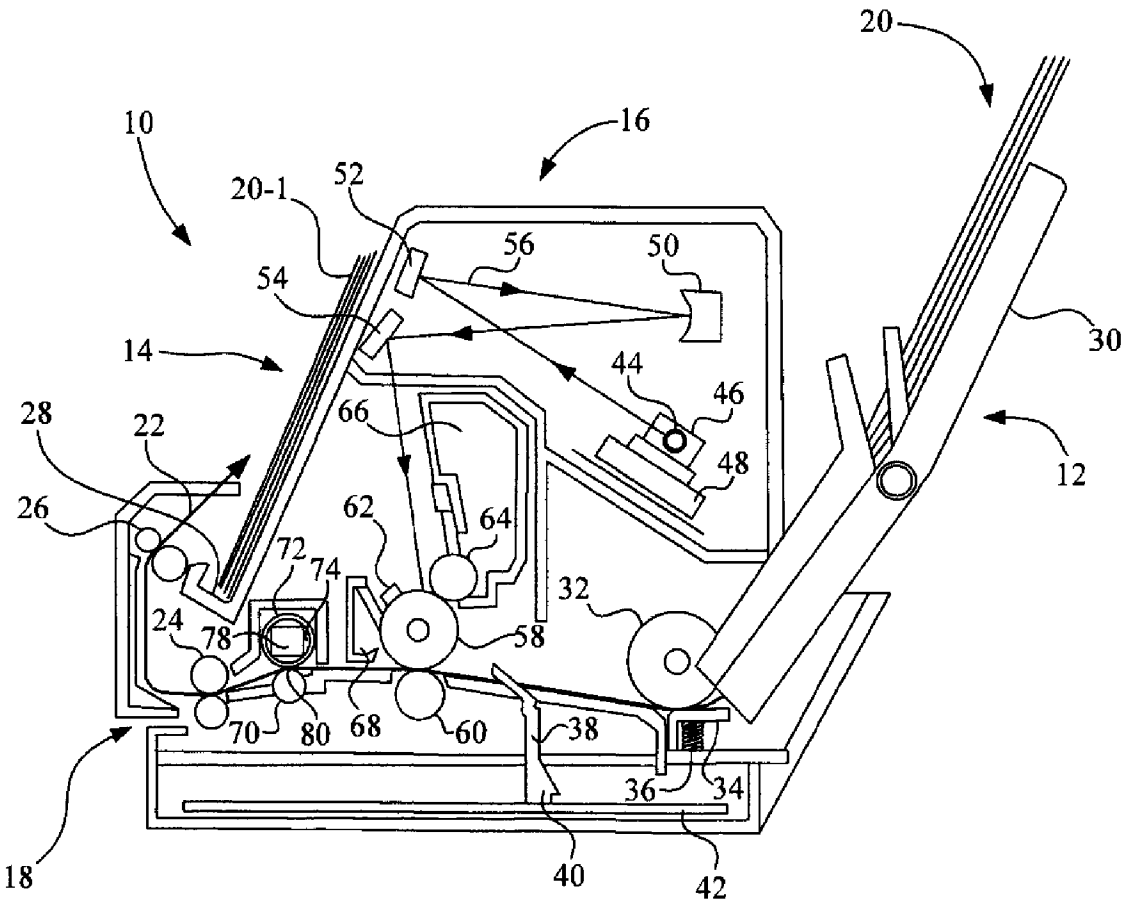
FIG. 2 is a diagrammatic representation of an electrophotographic imaging apparatus configured in accordance with an embodiment of the present invention.

Referring now to the drawings and particularly to FIG. 2, there is shown an exemplary electrophotographic imaging apparatus 10, e.g., a last printer, configured in accordance with an embodiment of the present invention. Imaging apparatus 10 includes a media feed section 12, an image-forming device 14, a laser scanning device 16, and a fuser assembly 18.

Media feed section 12 sequentially transports a sheet of print media (e.g., paper) 20-1 from a stack of sheets of print media 20 to image-forming device 14. Each sheet of print media 20-1 moves along a media feed path 22. Image-forming device 14 transfer a toner image to transported sheet of print media 20-1. Fuser assembly 18 fixes the toner image to the sheet of print media 20-1 sent from image-forming device 14. Thereafter, the sheet of print media 20-1 is ejected out of imaging apparatus 10 by media transport rollers 24, 26 and into output tray 28.

In the exemplary imaging apparatus 10, the media feed section 12 includes a feed tray 30, a feed roller 32, a media separating friction plate 34, a pressure spring 36, a media detection actuator 38, a media detection sensor 40, and a control circuit 42. Upon receiving a print instruction, the sheets of print media 20 which have been placed in media feed tray 30 are fed one-by-one by operation of feed roller 32, media separating friction plate 34 and pressure spring 36. As the fed sheet of print media 20-1 pushes down media detection actuator 38, media detection sensor 40 outputs an electrical signal instructing commencement of printing of the image. Control circuit 42, started by operation of media detection actuator 38, transmits an image signal to a laser diode light-emitting unit 44 of laser scanning device 16 so as to control the ON/OFF condition of its associated light-emitting diode Laser scanning device 16 includes laser diode light-emitting unit 44, a scanning mirror 46, a scanning mirror motor 48, and reflecting mirrors 50, 52, and 54. Scanning mirror 46 is rotated at a constant high speed by scanning mirror motor 48 such that laser light beam 56 scans in a vertical direction to the print media surface. The laser light beam 56 radiated by laser diode light-scanning unit 44 is reflected by reflecting mirrors 50, 52, and 54 so as to be applied to a photosensitive body 58 of image-forming device 14. When the laser light beam 56 is applied to photosensitive body 58, photosensitive body 58 is selectively exposed to the laser light beam 56 in accordance with ON/OFF information from control circuit 42.

In addition to photosensitive body 58, image-forming device 14 includes a transfer roller 60, a charging member 62, and a developer, including a developing roller 64, a developing unit 66, and a cleaning unit 68. The surface charge of photosensitive body 58, charged in advance by charging member 62, is selectively discharged by the laser light beam 56. An electrostatic latent image is visualized by developing roller 64, and developing unit 66. Specifically, the toner supplied from developing unit 66 is adhered to the electrostatic latent image on photosensitive body 58 by developing roller 64 so as to form the toner image.

Toner used for development is stored in developing unit 66. The toner contains coloring components (such as carbon black for black toner) and thermoplastic components. The toner, charged by being appropriately stirred in developing unit 66, adheres to the above-mentioned electrostatic latent image by an interaction of the developing bias voltage applied to developing roller 64 and an electric field generated by the surface potential of photosensitive body 58, and thus conforms to the latent image, forming a visual toner image on photosensitive body 58. The toner typically has a negative charge when it is applied to the latent image, forming the visual toner image The sheet of print media 20-1 transported from media feed section 12 is transported downstream while being pinched by photosensitive body 58 and transfer roller 60. The sheet of print media 20-1 arrives at the transfer nip in timed coordination with the toned image on the photosensitive body 58. As the sheet of print media 20-1 is transported downstream, the toner image formed on photosensitive body 58 is electrically attracted and transferred to the sheet of print media 20-1 by an interaction with the electrostatic field generated by transfer voltage applied to transfer roller 60. Any toner that still remains on photosensitive body 58, not having been transferred to the sheet of print media 20-1, is collected by cleaning unit 68 Thereafter, the sheet of print media 20-1 is transported to fuser assembly 18

Figure 3:
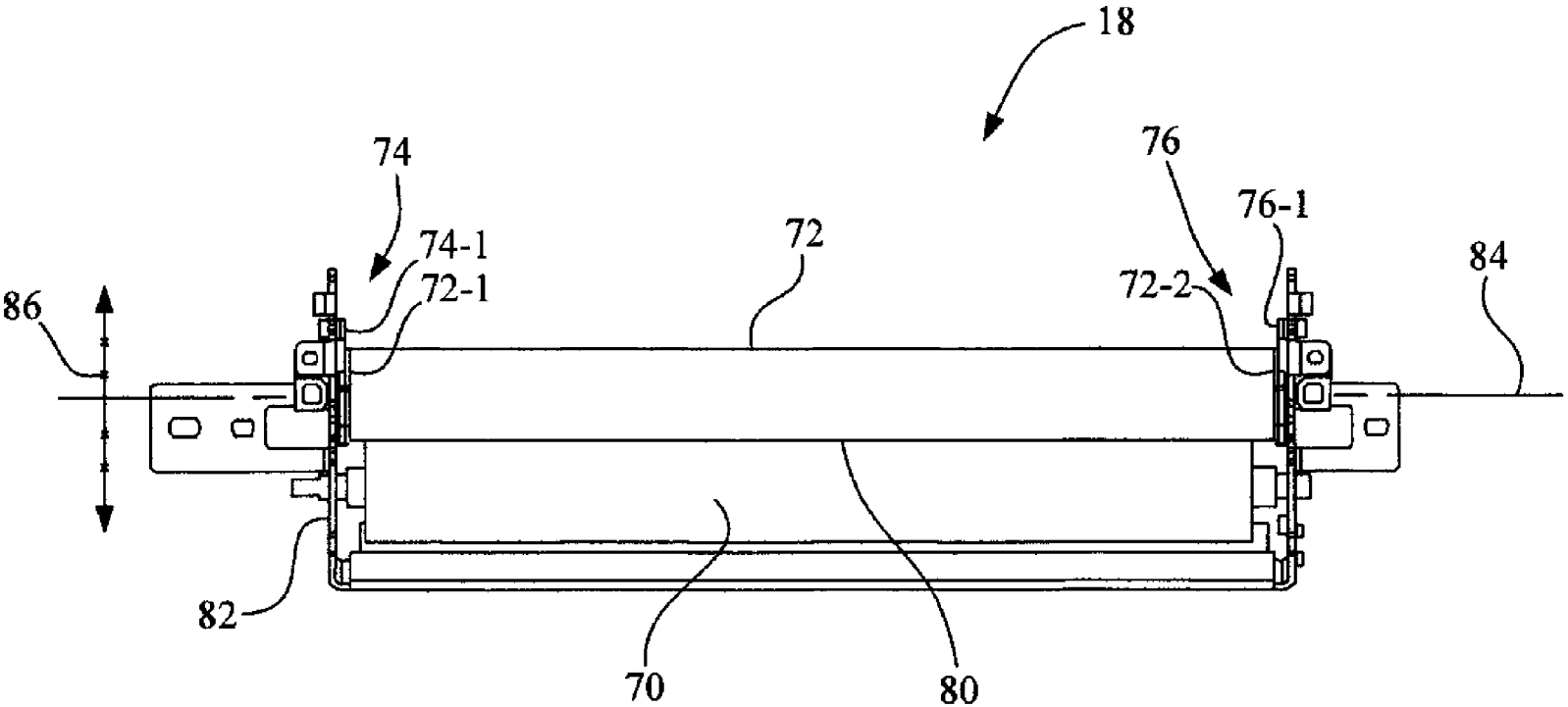
FIG. 3 is a front view of a fuser assembly used with the electrophotographic imaging apparatus, and having compliant stopping flanges positioned to engage side edges of a fuser belt.

Referring to FIGS. 2 and 3, fuser assembly 18 may include a backup roller 70, a fuser belt 72, a plurality of end cap assemblies 74, 76, and a heater unit 78. Backup roller 70 and fuser belt 72 are positioned to form a fuser nip 80, and are mounted to a frame 82. Fuser belt 72 is mounted to frame 82 via the end cap assemblies 74, 76.

The backup (i.e., pressure) roller 70 may be generally cylindrical in shape. Backup roller 70 may be made from , or is coated with, a material that has good release and transport properties for the sheet of print media 20-1. Backup roller 70 may be sufficiently soft so as to allow it to be rotated against fuser belt 72 to form fuser nip 80 through which the printed sheets of print media 20 travel. As a printed sheet of print media 20-1 passes through fuser nip 80, the sheet is placed under pressure, and the combined effects of this pressure, the time the sheet is in fuser nip 80, and the heat from fuser belt 72 acts to fix the toner onto the sheet of print media 20-1. Typically, the pressure between fuser belt 72 and backup roller 70 at fuser nip 80 is from about 5 pound per square inch (psi) to 30 psi.

Backup roller 70 made formed, for example, form silicone rubber. In one embodiment, backup roller 70 has an aluminum core with a silicone rubber layer molded or adhesively bonded onto its surface. Backup roller 70 may also have a fluoropolymer, e.g., Teflon® sleeve or coating. Backup roller 70 may be essentially hollow, having a metallic core, an outer metallic shell surrounding and essentially concentric with the core, and ribs between the core and the outer shell.

Fuser belt 72 is an endless belt having a first side edge 72-1 and a second side edge 72-2. Fuser belt 72 is formed from a highly heat resistive and durable material having good parting properties and a thickness of not more than about 75 microns, and in one embodiment may be about 50 microns. Fuser belt 72 may be formed, for example, from a polyimide film or metal. Fuser belt 72 may have an outer coating of, for example, a fluororesin of Teflon® material to optimize release properties of the fixed toner. Fuser belt 72 may be shaped, for example, as a tube.

Heater unit 78, e.g., a ceramic heater, is held by a housing generally made of plastic. Each end cap assembly 74 and 76 is attached to this housing. Heater unit 78 is thermally coupled to fuser belt 72. In fuser assembly 18, an appropriate temperatures and pressure are applied while the sheet of print media 20-1 is being pinched by moving through fuser nip 80 formed by a backup roller 70 and a fuser belt 72 that is maintained at an elevated temperature. The thermoplastic components of the toner are melted by fuser belt 72 and fixed to the sheet of print media 20-1 to form the fixed image. The sheet of print media 20-1 is then transported and ejected out of the printer by media transport rollers 24, 26 and into output tray 28 where it may be stacked, one sheet upon another.

End cap assemblies 74, 76 are configured in accordance with the present invention to reduce wear and deformation of fuser belt 72. In the present embodiment, end cap assemblies 74, 76 may be configured structurally to be mirror images of one another, i.e., configured to be substantially identical. End cap assemblies 74, 76 are positioned to control an axial location of fuser belt 72 along an axis 84 and control a radial location of fuser belt 72 in radial direction 86. End cap assembly 74 has a compliant stopping flange 74-1 positioned to engage first side edge 72-1 of fuser belt 72, if fuser belt 72 drifts sideways, i.e., axially along axis 84, to the left in the orientation as shown in FIG. 2. End cap assembly 76 has a compliant stopping flange 76-1 positioned to engage second side edge 72-2 of fuser belt 72, if fuser belt 72 drifts sideways, i.e., axially along axis 84, to the right in the orientation as shown in FIG. 3. As used herein, the term compliant flange means a component, such as a thrust bearing, e.g., a thrust washer, configured to allow flexure in a direction of axial extent, i.e., in the direction(s) of axis 84.

Figure 4:
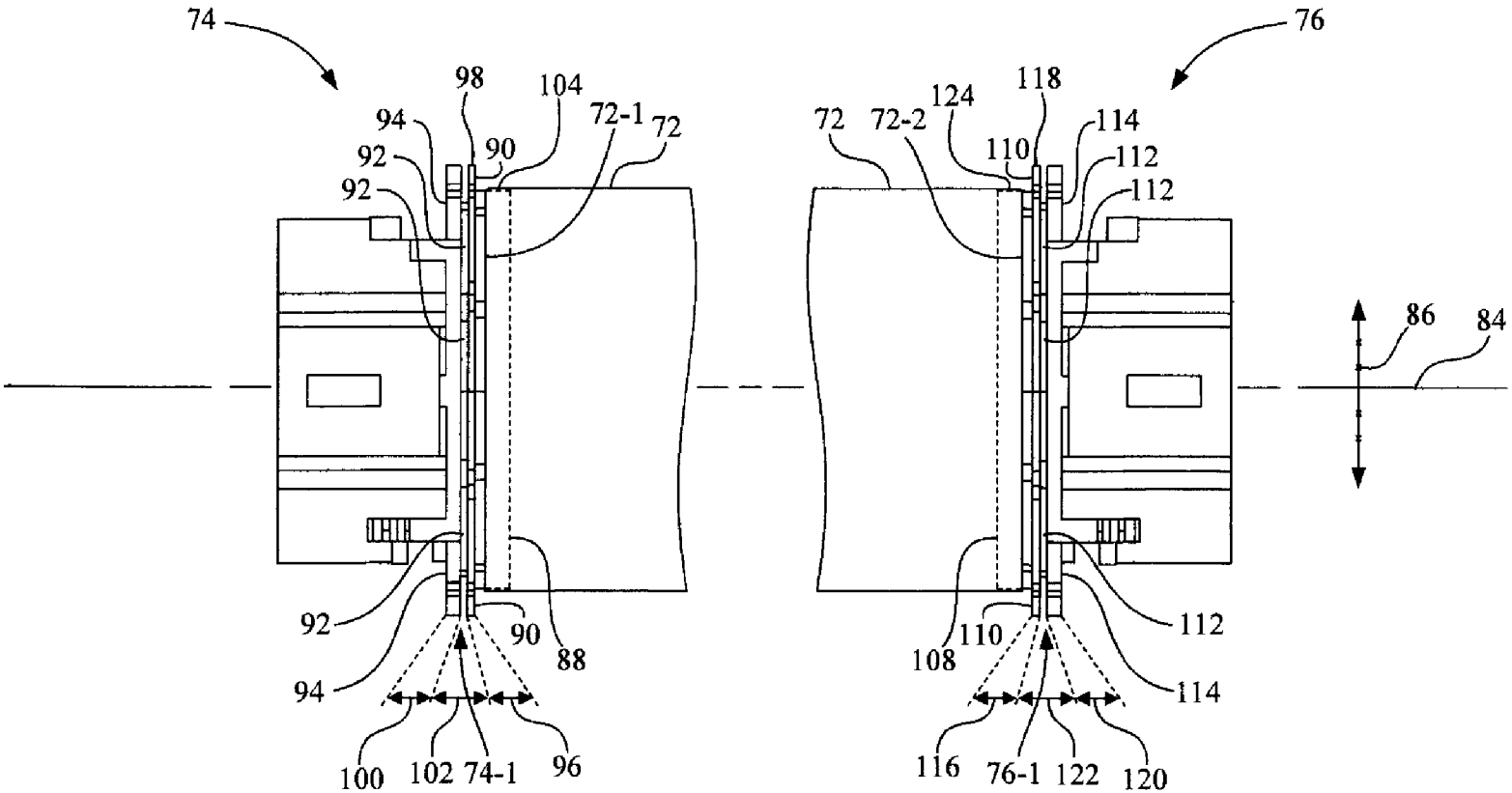
FIG. 4 is a more detailed top view of the fuser assembly of FIG. 3.

Referring also to FIG. 4, end cap assembly 74 includes an end cap body 88, a flexible thrust bearing 90, and a plurality of spacer standoffs 92. End cap body 88 has a rigid outer flange 94.

Flexible thrust bearing 90 has an axial extent along axis 84 as a thickness 96, and has a radial extent in radial directions 86 perpendicular to axis 84 defining an outer perimeter 98, and is flexible in a direction of the axial extent along axis 84. Flexible thrust bearing 90 has a spring rate in a direction of the axial extent selected to allow flexible thrust bearing 90 to deflect in the direction of the axial extent when flexible thrust bearing 90 is engaged by the respective side edge 72-1 of fuser belt 72.

Rigid outer flange 94 has an axial extent along axis 84 as a thickness 100, and has a radial extent in radial directions 86 perpendicular to axis 84. The spacer standoffs 92 are positioned between rigid outer flange 94 and flexible thrust bearing 90, and define a spacing distance 102. The plurality of spacer standoffs 92 are positioned to cantilever the radial extent of flexible thrust bearing 90, e.g. toward outer perimeter 98, when flexible thrust bearing 90 is engaged by a respective side edge 72-1 of fuser belt 72.

End cap assembly 76 is substantially a mirror image of end cap assembly 74. End cap assembly 76 includes an end cap body 108, a flexible thrust bearing 110, and a plurality of spacer standoffs 112. End cap body 108 has a rigid outer flange 114.

Flexible thrust bearing 110 has an axial extent along axis 84 as a thickness 116, and has a radial extent in radial direction 86 perpendicular to axis 84 defining an outer perimeter 118, and is flexible in a direction of the axial extent along axis 84. Flexible thrust bearing 110 has a spring rate in a direction of the axial extent selected to allow flexible thrust bearing 110 to deflect in the direction of the axial extent when flexible thrust bearing 110 is engaged by the respective side edge 72-2 of fuser belt 72.

Rigid outer flange 114 has an axial extent along axis 84 as a thickness 120, and has a radial extent in radial directions 86 perpendicular to axis 84. The spacer standoffs 112 are positioned between rigid outer flange 114 and flexible thrust bearing 110, and define a spacing distance 122. The plurality of spacer standoffs are positioned to cantilever the radial extent of flexible thrust bearing 110, e.g. at outer perimeter 118, when flexible thrust bearing 110 is engaged by a respective side edge 72-2 of fuser belt 72.

Each of end cap bodies 88, 108 has a respective support surface 104, 124, respectively, which may be for example, a circular surface of an elliptical surface, that fits inside an inside diameter of fuser belt 72. The end cap bodies 88, 108 are stationary, e.g., do not rotate with the rotation of fuser belt 72.

Figure 5A:
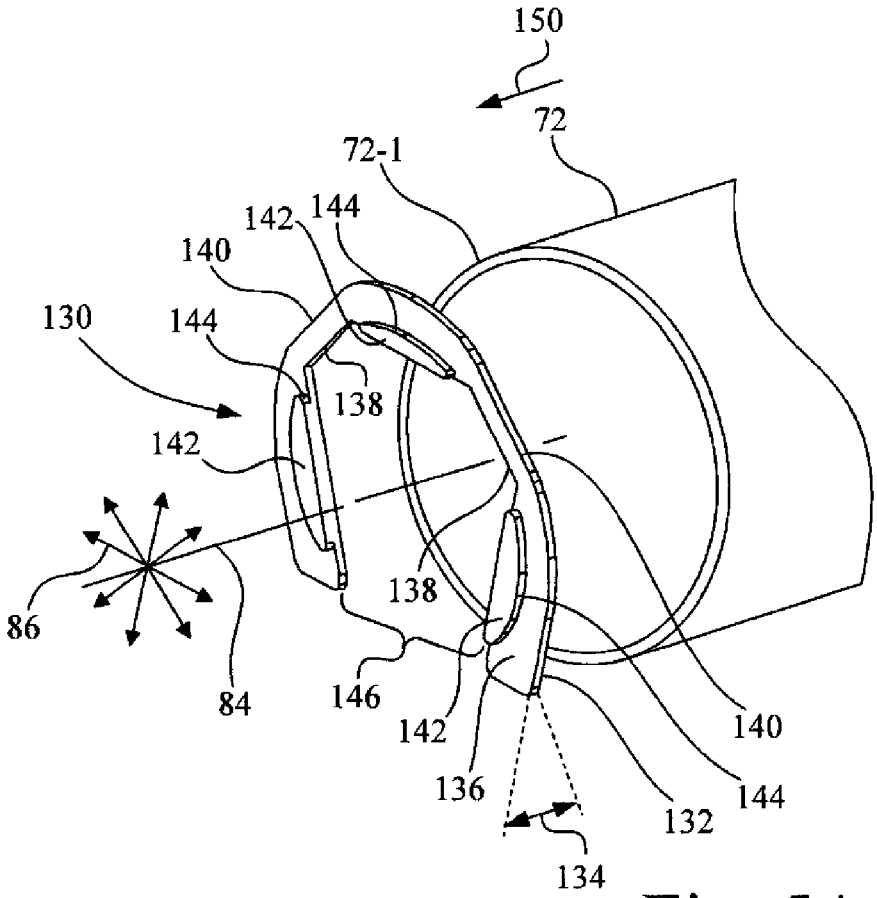
FIG. 5A is a perspective view of a flexible thrust bearing configured in accordance with one embodiment of the present invention.
Figure 5B:
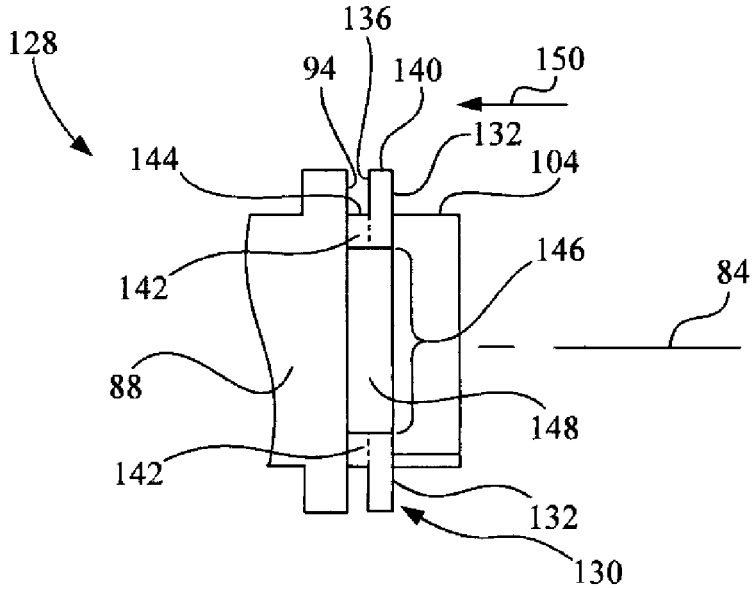
FIG. 5B is an exaggerated side view (not to scale) of an end cap assembly using the flexible thrust bearing of FIG. 5A, and configured for use in the fuser assembly shown in FIGS. 3 and 4.

Referring to FIGS. 5A and 5B, an end cap assembly 128 is shown representing an embodiment formed by a combination of the plurality of spacer standoffs 92 integrally incorporated into flexible thrust bearing 90, and/or by a combination of the plurality of spacer standoffs 112 integrally incorporated into flexible thrust bearing 110, to form an integral flexible thrust bearing 130. Thus, in the present embodiment, the flexible thrust bearing and the plurality of spacer standoffs are formed as a single piece.

Flexible thrust bearing 130 has an interior surface 132 spaced by thickness 134 from an outer surface 136, and an inside perimeter 138 spaced by a radial extent in radial directions 86 from an outside perimeter 140. Interior surface 132 is positioned to engage the respective side edge 72-1 or 72-2 of fuser belt 72 at a location radially spaced away from inside perimeter 138. A plurality of spacer standoffs 142 is located at outer surface 136 adjacent to inside perimeter 138, whereby defining a standoff ledge 144 having a predefined thickness. Flexible thrust bearing 130 has a radial gap 146 to aid in installation.

Flexible thrust bearing 130 may be made of a high temperature plastic that does not include glass fibers, and interior surface 132 is a smooth surface for contacting the respective side edge 72-1 or 72-2 of fuser belt 72. Alternatively, flexible thrust bearing 130 may be made of metal, and interior surface 132 is a smooth surface for contacting the respective side edge 72-1 or 72-2 of fuser belt 72.

Referring to FIG. 5B, an end cap body, e.g., end cap body 88, has a perimetrical groove 148 adjacent to rigid outer flange 94. In the present embodiment, flexible thrust bearing 130 is radially inserted, i.e., slid, into perimetrical groove 148, with the plurality of spacer standoffs 142 facing rigid outer flange 94. Referring also to FIG. 5A, flexible thrust bearing 130 has a spring rate in a direction of the axial extent, e.g., along axis 84 in direction 150, that is selected to allow flexible thrust bearing 130 to deflect in the direction 150 of axial extent when flexible thrust bearing 130 is engaged by the respective side edge, e.g., side edge 72-1, of fuser belt 72. In other words, the plurality of spacer standoffs 142 are positioned adjacent rigid outer flange 94 to cantilever the radial extent, e.g., in radial direction 86, of flexible thrust bearing 130 when flexible thrust bearing 130 is engaged on interior surface 132 near outside perimeter 140 by a respective side edge, e.g., side edge 72-1, of fuser belt 72.

Figure 6A:
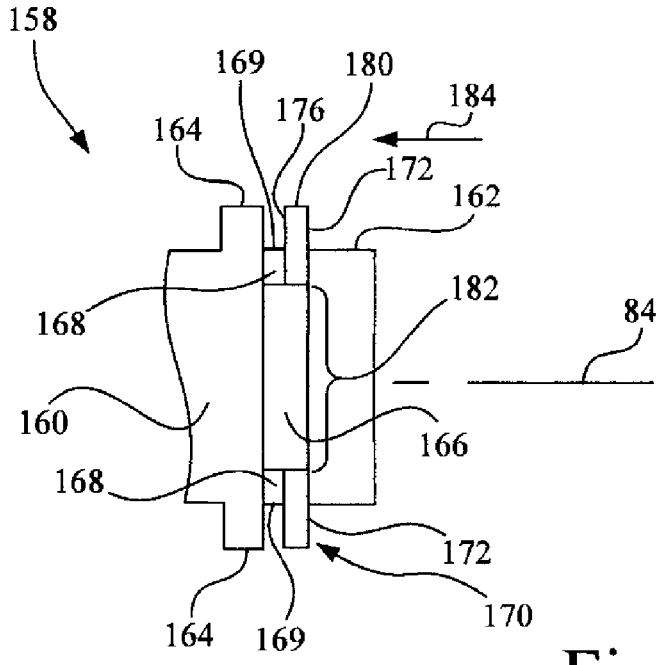
FIG. 6A is an exaggerated side view (not to scale) of an end cap assembly using the flexible thrust bearing of FIG. 6B, and configured for use in the fuser assembly shown in FIGS. 3 and 4.

Referring to FIG. 6A, an end cap assembly 158 is shown representing an embodiment formed by a combination of the plurality of spacer standoffs 92 formed on, e.g., integrally incorporated into, rigid outer flange 94, and/or in a combination of the plurality of spacer standoffs 112 formed on, e.g., integrally incorporated into, rigid outer flange 114, to form an integral end cap body 160. Thus, in the present embodiment, the end cap body and the plurality of spacer standoffs are formed as a single piece.

End cap assembly 158 includes an end cap body, e.g., end cap body 160, a support surface 162, a rigid outer flange 164, and a perimetrical groove 166 located between support surface 162 and rigid outer flange 164, and may be adjacent to rigid outer flange 164. Support surface 162 may be cylindrical or elliptical, and is received into an end of fuser belt 72 at a respective side edge 72-1 or 72-2. In the present embodiment, within perimetrical groove 166 there is a plurality of spacer standoffs 168 formed on, and extending outwardly from, rigid outer flange 164 into perimetrical groove 166. The plurality of spacer standoffs 168 defines a standoff ledge 169 having a predefined thickness. A flexible thrust bearing 170 is radially inserted, i.e., slid, into perimetrical groove 166.

Figure 6B:
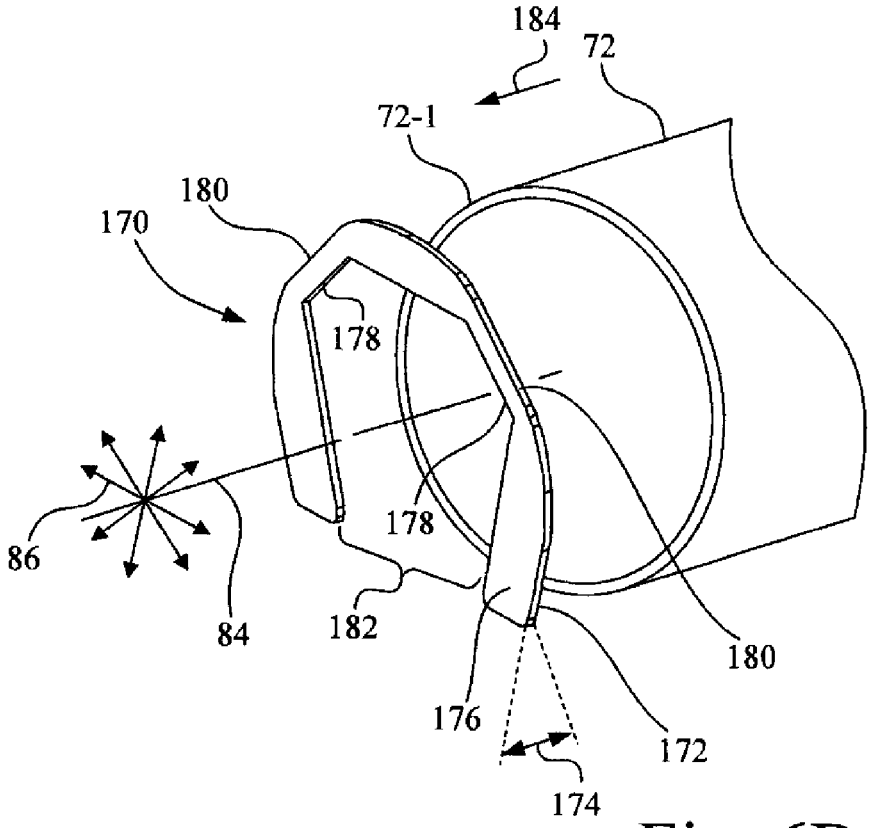
FIG. 6B is a perspective view of a flexible thrust bearing configured for use in the embodiment of FIG. 6A.

Referring also to FIG. 6B, flexible thrust bearing 170 has an interior surface 172 spaced by thickness 174 form an outer surface 176, and an inside perimeter 178 spaced by a radial extent in radial directions 86 form an outside perimeter 180. Flexible thrust bearing 170 has a radial gap 182 to aid in installation. Flexible thrust bearing 170 has a spring rate in a direction of the axial extent, e.g., along axis 84 in direction 184, that is selected to allow flexible thrust bearing 170 to deflect in the direction 184 of axial extent when flexible thrust bearing 170 is engaged by the respective side edge, e.g., side edge 72-1, of fuser belt 72. In other words, the plurality of spacer standoffs 168 are positioned to engage outer surface 176 of flexible thrust bearing 170 near inside perimeter 178 to cantilever the radial extent, e.g., in radial directions 86, of flexible thrust bearing 170 when flexible thrust bearing 170 is engaged near outside perimeter 180 by a respective side edge, e.g., side edge 72-1, of fuser belt 72.

Flexible thrust bearing 170 may be made of a high temperature plastic that does not include glass fibers, and interior surface 172 is a smooth surface for contacting the respective side edge 72-1 or 72-2 of fuser belt 72. Alternatively, flexible thrust bearing 170 may be made of metal, and interior surface 172 is a smooth surface for contacting the respective side edge 72-1 or 72-2 of fuser belt 72.

Figure 1:
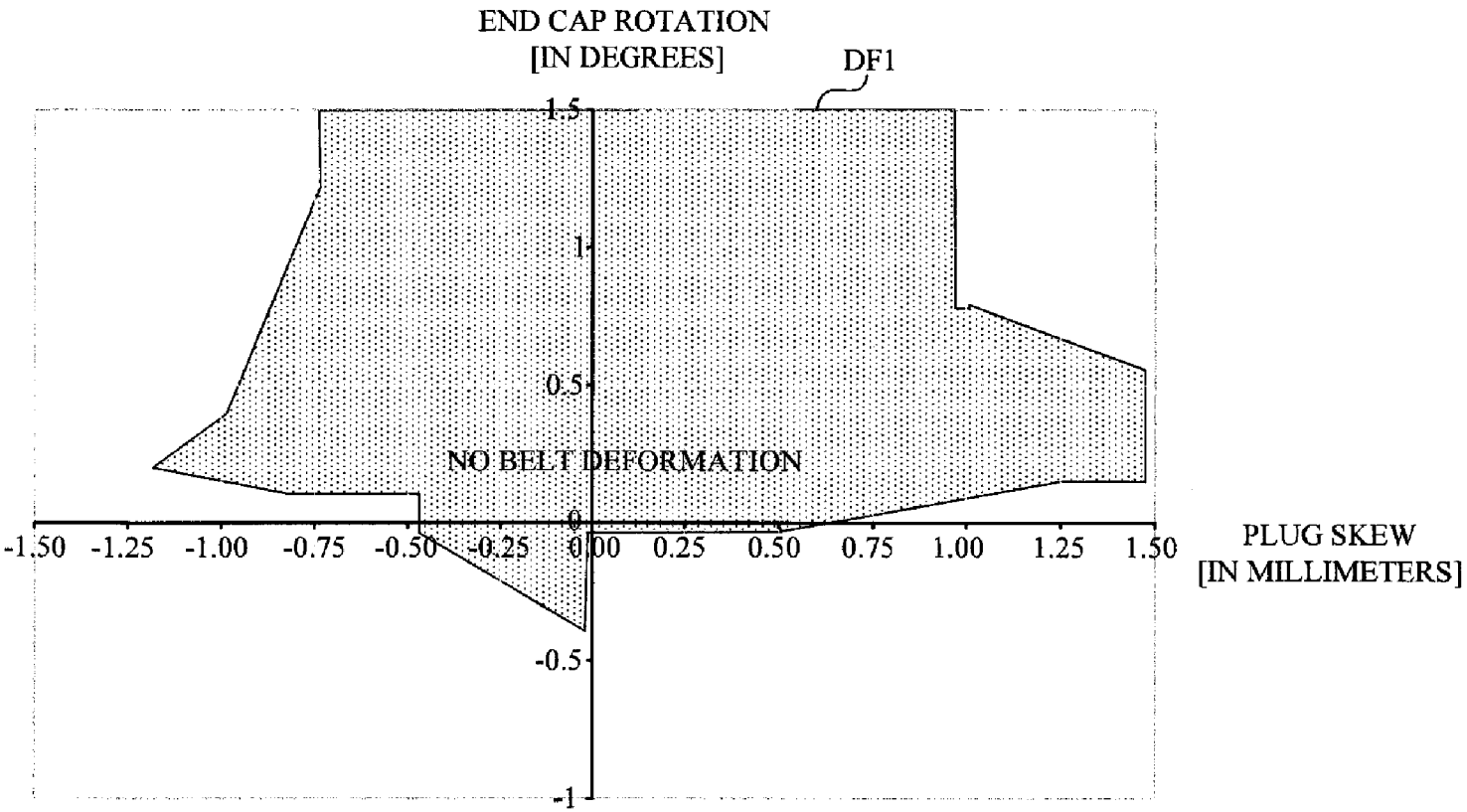
Fig. 1 (PRIOR ART)
FIG. 1 is a graph having a shaded area representing a region of no belt deformation of a prior art fuser system.
Figure 7:
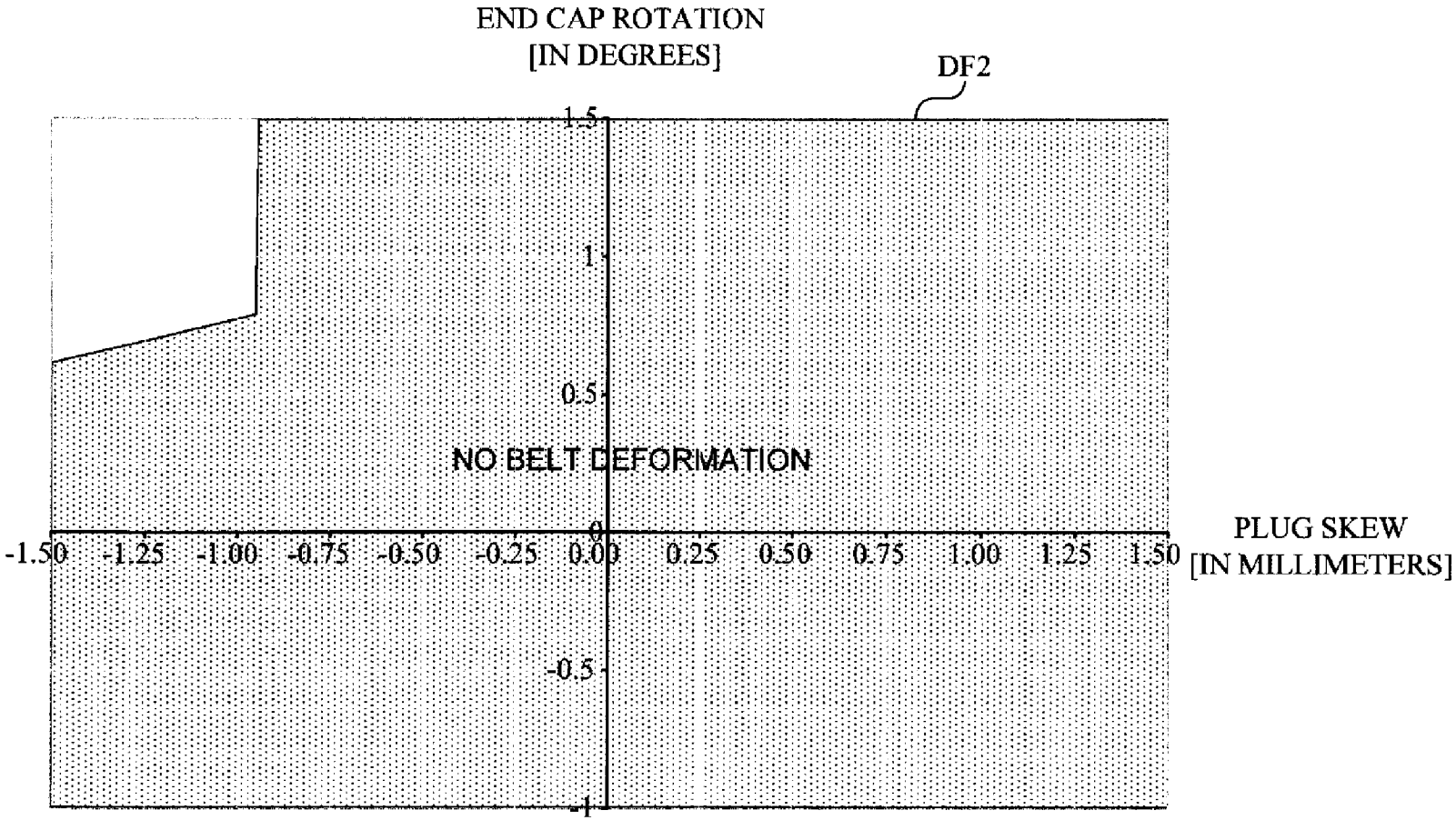
FIG. 7 is a graph having a shaded area representing a region of no belt deformation for a fuser assembly configured in accordance with the present invention.

The FIG. 7 is a graph having a shaded area DF2 representing a region of no belt deformation for fuser assembly 18 configured with compliant stopping flanges positioned to engage the side edges of fuser belt 72 is fuser belt 72 shifts right or left during rotation. In FIG. 7, the X axis is the relative angle between the belt axis of rotation and the back up roll axis of rotation that is given in terms of a displacement of the AC connector end of the ceramic heater with respect to the back up roll shaft, which is called plug skew in millimeters (mm). The Y axis is the rotation of the end cap flange in degrees. As is observed from the graph of FIG. 7, shaded area DF2 is much larger the shaded area DF1 of FIG. 1, thus demonstrating an improvement in increasing the range of no belt deformation in comparison to prior art fuser systems represented by FIG. 1.

While this invention has been described with respect to embodiments of the invention, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A fuser assembly configured to fix a toner image to a sheet a print media, said fuser assembly comprising:

a fuser belt having a first side edge and a second side edge; and a plurality of end cap assemblies positioned to locate said fuser belt, said plurality of end cap assemblies including:

a first end cap assembly having a first compliant stopping flange positioned to engage said first side edge of said fuser belt, and a second end cap assembly having a second compliant flange positioned to engage said second side edge of said fuser belt, wherein each of said first compliant stopping flange and said second compliant stopping flange includes a flexible thrust bearing having an axial extent along an axis as a thickness, and having a radial extent perpendicular to said axis, said flexible thrust bearing being flexible in a direction of said axial extent such that a spring rate of said flexible thrust bearing in a direction of said axial extent allows said flexible thrust bearing to deflect in said direction of said axial extent when said flexible thrust bearing is engaged by a respective side edge of said fuser belt.

2. The fuser assembly of claim 1, wherein each of said first compliant stopping flange and said second compliant stopping flange further includes:

an end cap body having a rigid outer flange; and a plurality of spacer standoffs positioned between said rigid outer flange and said flexible thrust bearing, and positioned to cantilever said radial extent of said flexible thrust bearing when said flexible bearing is engaged by said respective side edge of said fuser belt.

3. The fuser assembly of claim 2, wherein said flexible thrust bearing has an interior surface spaced by said thickness from an outer surface, and an inside perimeter spaced by said radial extent form an outside perimeter, with said interior surface positioned to engage said respective side edge of said fuser belt at a location radially spaced away from said inside perimeter.

4. The fuser assembly of claim 3, wherein said flexible thrust bearing and said plurality of spacer standoffs are formed as a single piece, with said plurality of spacer standoffs being located at said outer surface adjacent to said inside perimeter.

5. The fuser assembly of claim 3, wherein said plurality of spacer standoffs are formed on said rigid outer flange, and positioned to engage said outer surface of said flexible thrust bearing at a location adjacent to said inside perimeter.

6. The fuser assembly of claim 2, wherein said end cap body has a perimetrical groove adjacent to said rigid outer flange, and said flexible thrust bearing has a radial gap, said flexible thrust bearing being inserted into said perimetrical groove.

7. The fuser assembly of claim 2, wherein said flexible thrust bearing is made of a high temperature plastic that does not include glass fibers, and has a smooth surface for contacting said respective side edge of said fuser belt.

8. The fuser assembly of claim 2, wherein said flexible thrust bearing is made of metal, and has a smooth surface for contacting said respective side edge of said fuser belt.

9. The fuser assembly of claim 1, wherein each of said first compliant stopping flange and said second compliant stopping flange includes:

an end cap body having a perimetrical groove, the thrust bearing having a radial gap along said radial extent to accommodate said thrust bearing being slid into said perimetrical groove.

10. An electrophotographic imaging apparatus for forming an image on a sheet of print media, comprising:

a media feed section for feeding said sheet of print media along a media feed path;

a laser scanning device configured to produce a scanned light beam;

an image-forming device having a photosensitive body, and configured to use said scanned light beam to form a latent image on said photosensitive body and develop said latent image to form a toner image that is transferred to said sheet of print media; and a fuser assembly configured to fix said toner image to said sheet of print media, said fuser assembly including:

a fuser belt having a first side edge and a second side edge; and a plurality of end cap assemblies positioned to locate said fuser belt, said plurality of end cap assemblies including:

a first end cap assembly having a first compliant stopping flange positioned to engage said first side edge of said fuser belt, and a second end cap assembly having a second compliant flange positioned to engage said second side edge of said fuser belt, wherein each of said first compliant stopping flange and said second compliant stopping flange includes a flexible thrust bearing having an axial extent along an axis as a thickness, and having a radial extent perpendicular to said axis, said flexible thrust bearing being flexible in a direction of said axial extent such that said flexible thrust bearing has a spring rate in a direction of said axial extent such that said flexible thrust bearing in said direction of said axial extent when said flexible thrust bearing is engaged by a respective side edge of said fuser belt.

11. The electrophotographic imaging apparatus of claim 10, wherein each of said first compliant stopping flange and said second compliant stopping flange further includes:

an end cap body having a rigid outer flange; and a plurality of spacer standoffs positioned between said rigid outer flange and said flexible thrust bearing, and positioned to cantilever said radial extent of said flexible thrust bearing when said flexible thrust bearing is engaged by said respective side edge of said fuser belt.

12. The electrophotographic imaging apparatus of claim 11, wherein said flexible thrust bearing has an interior surface spaced by said thickness form an outer surface, and an inside perimeter spaced by said radial extent form an outside perimeter, with said interior surface positioned to engage said respective side edge of said fuser belt at a location radially spaced away from said inside perimeter.

13. The electrophotographic imaging apparatus of claim 12, wherein said flexible thrust bearing and said plurality of spacer standoffs are formed as a single piece, with said plurality of spacer standoffs being located at said outer surface adjacent to said inside perimeter.

14. The electrophotographic imaging apparatus of claim 12, wherein said plurality of spacer standoffs are formed on said rigid outer flange, and positioned to engage said outer surface of said flexible thrust bearing at a location adjacent to said inside perimeter.

15. The electrophotographic imaging apparatus of claim 11, wherein said end cap body has a perimetrical groove adjacent to said rigid outer flange, and said flexible thrust bearing has a radial gap, said flexible thrust bearing being inserted into said perimetrical groove.

16. The electrophotographic imaging apparatus of claim 11, wherein said flexible thrust bearing is made of a high temperature plastic that does not include glass fibers, and has a smooth surface for contacting said respective side edge of said fuser belt.

17. The electrophotographic imaging apparatus of claim 11, wherein said flexible thrust bearing is made of metal, and has a smooth surface for contacting said respective side edge of said fuser belt.

18. The electrophotographic imaging apparatus of claim 10, wherein each of said first compliant stopping flange and said second compliant stopping flange includes:

an end cap body having a perimetrical groove, the thrust bearing having a radial gap along said radial extent to accommodate said thrust bearing being slid into said perimetrical groove.

19. The electrophotographic imaging apparatus for forming an image on a sheet of print media, comprising:

a media feed section for feeding said sheet of print media along a media feed path;

a laser scanning device configured to produce a scanned light beam;

an image-forming device having a photosensitive body, and configured to use said scanned light beam to form a latent image on said photosensitive body and develop said latent image to form a toner image that is transferred to said sheet of print media; and a fuser assembly configured to fix said toner image to said sheet of print media, said fuser assembly including:

a fuser belt having a first side edge and a second side edge; and a plurality of end cap assemblies positioned to locate said fuser belt, said plurality of end cap assemblies including:

a first end cap assembly having a first compliant stopping flange positioned to engage said first side edge of said fuser belt, and a second end cap assembly having a second compliant flange positioned to engaged said second side of said fuser belt, wherein each of said first compliant stopping flange and said second compliant stopping flange includes:

an end cap body having a perimetrical groove; and a thrust bearing having an axial extent along an axis as a thickness, and having a radial extent perpendicular to said axis, said thrust bearing being flexible in a direction of said axial extent, and having a radial gap along said radial extent to accommodate said thrust bearing being slid into said perimetrical groove.

* * * * *